United States Patent [19]

Suga

[11] Patent Number: 5,017,966

[45] Date of Patent: May 21, 1991

[54] TONER CARTRIDGE AND IMAGE FORMING APPARATUS HAVING THE TONER CARTRIDGE

[75] Inventor: Takayuki Suga, Tokyo, Japan

[73] Assignee: Kabushiki Kaisha Toshiba, Kawasaki, Japan

[21] Appl. No.: 426,590

[22] Filed: Oct. 25, 1989

[30] Foreign Application Priority Data

Oct. 31, 1988 [JP] Japan ..... 63-273058

[51] Int. Cl.[5] ..... G03G 15/06; G03G 21/00

[52] U.S. Cl. ..... 355/260; 222/DIG. 1; 366/108; 366/319; 355/245

[58] Field of Search ..... 355/260, 245, 246, 259; 366/108, 118, 319; 222/DIG. 1

[56] References Cited

U.S. PATENT DOCUMENTS

| | | | |
|---|---|---|---|
| 3,572,555 | 3/1971 | Knight et al. | 222/DIG. 1 |
| 4,260,073 | 4/1981 | Baumann | 222/DIG. 1 |
| 4,523,615 | 6/1985 | Feeustra et al. | 355/260 X |
| 4,602,862 | 7/1986 | Wyble | 222/DIG. 1 |
| 4,650,097 | 3/1987 | Hagihara et al. | 222/DIG. 1 |
| 4,686,934 | 8/1987 | Kohyama | 118/651 |
| 4,803,513 | 2/1989 | Nishise et al. | 355/260 X |
| 4,811,867 | 3/1989 | Deyle, Jr. et al. | 222/DIG. 1 |

FOREIGN PATENT DOCUMENTS

| | | | |
|---|---|---|---|
| 0182476 | 10/1984 | Japan | 355/260 |
| 0080879 | 5/1985 | Japan | 355/260 |
| 0151667 | 8/1985 | Japan | 355/260 |
| 0083759 | 4/1988 | Japan | 355/260 |

*Primary Examiner*—A. T. Grimley
*Assistant Examiner*—Matthew S. Smith
*Attorney, Agent, or Firm*—Foley & Lardner

[57] ABSTRACT

A toner cartridge includes a hopper having two inclined lower surfaces. A toner outlet port is formed in one of the lower surfaces. A toner-supplying auger is located within the toner cartridge near the lower surfaces to guide toner. A toner-receiving plate is loosely mounted on the inclined lower surfaces of the hopper to be vibrated. This plate has an opening through which the toner may fall from the hopper onto the auger. Two pins protrude from the periphery of the auger. As the auger is rotated, the pins strike the toner-receiving plate, thus vibrating the plate. As the plate is vibrated, the resultant stirring guides the toner to the opening. The toner guiding means are arranged to substantially superpose the lower surfaces of the cartridge.

23 Claims, 8 Drawing Sheets

TONER CARTRIDGE AND IMAGE FORMING APPARATUS HAVING THE TONER CARTRIDGE

BACKGROUND OF THE INVENTION

1. Field of the Invention

The present invention relates to a toner cartridge and an image forming apparatus, such as an electronic copying machine having a toner cartridge, and more particularly to a toner cartridge having a mechanism for preventing toner from cohering into a solid mass, and an image forming apparatus provided with this toner cartridge.

2. Description of the Related Art

An image forming apparatus such as a desk-top copier has a developer unit, which has toner supply means for supplying toner, i.e., an agent for developing images. The toner supply means can be of the known type including a toner cartridge. When the toner cartridge becomes empty, it is replaced by a new one, filled with toner.

U.S. Pat. No. 4,686,934 discloses a toner cartridge which comprises a housing containing toner and having a toner supply port, a toner transport auger for transporting the toner to the toner supply port, and toner-stirring means for stirring the toner, thus preventing the toner from cohering into a solid mass. The toner-stirring means comprises a stirring paddle, a first gear integrally formed with the stirring paddle, and a second gear integrally formed with the toner-transport auger and set in mesh with the first gear. When the toner-transport auger is driven by drive means (not shown), the second gear rotates the first gear, thereby rotating the stirring paddle. As a result, the paddle stirs the toner contained in the housing of the cartridge.

Since the stirring means has a complex structure, its production cost is high. Further, any part of the toner which is located outside the locus of the stirring paddle cannot be stirred at all. In order to stir all toner within the housing, the shape and size of the housing are both limited, and so is the amount of toner which the housing can contain. Thus, the toner cartridge must be replaced by a new one after a relatively short period of time. In other words, the cartridge cannot last a sufficiently long time, and is therefore uneconomical.

SUMMARY OF THE INVENTION

Accordingly, it is an object of the invention to provide a toner cartridge which can be made at a low cost, contains an increased amount of toner, and is economical and easy to maintain.

It is a further object of the present invention to provide an image forming apparatus which utilizes a toner cartridge described above.

According to the present invention, there is provided a toner cartridge for supplying toner to a developing device having a toner-inlet port, said toner cartridge comprising:

toner storage means having a first lower surface inclined downward toward a center line, a second lower surface inclined downward toward the lower end of the first lower surface, and a toner outlet port through which toner is supplied to the toner-inlet port of the developing device;

toner transport means located inside the toner storage means, for supplying toner to the toner outlet port;

toner-guiding means for guiding toner from the toner storage means to the toner transport means, said toner-guiding means having a first inclined plate overlapping the the first lower surface of the toner storage means, a second inclined plate overlapping the second lower surface of the toner storage means, and an opening formed in the lower end of the second inclined plate, for guiding toner to the toner transport means; and vibration means attached to the toner transport means, for vibrating the first and second inclined plates as the toner transport means operates to supply toner to the toner outlet port.

Since the toner-guiding means, which is located on the inclined lower surfaces of the toner storage means, is vibrated as the toner transport means operates, the toner contained in the storage means is also vibrated. Hence, the toner neither coheres into solid masses, nor sticks to the inner surfaces of the toner storage means. All toner in the storage means can thus be used to develop images, and the toner cartridge can last longer than normal. The toner cartridge can, therefore, contribute to easy maintenance of an image forming apparatus.

Further, the vibration means, which is attached to the toner transport means, requires no moving components such as the gears used in the toner-stirring means of a conventional toner cartridge, has a more simple structure and can be produced at lower cost.

The present invention further provides an image forming apparatus which comprises:

image-forming means for forming an image on an image carrier;

developing means for developing an image formed on the image carrier by the image-forming means; and a toner cartridge comprising:

toner storage means having a first lower surface inclined downward, a second lower surface inclined downward and toward the end of the first lower surface, and a toner outlet port through which toner is supplied to the toner inlet port of the developing device; toner transport means located in the toner storage means, for supplying toner to the toner outlet port; toner-guiding means for guiding toner from the toner storage means to the toner transport means, said toner-guiding means having a first inclined plate overlapping the first lower surface of the toner storage means, a second inclined plate overlapping the second ower surface of the toner storage means, and an opening formed in the lower end of the second inclined plate, for guiding toner to the toner transport means; and vibration means attached to the toner transport means, for vibrating the first and second inclined plates as the toner transport means operates to supply toner to the toner outlet port.

Since all toner contained in the toner cartridge can be used to develop images, the cartridge has a longer lifetime. In addition, since the toner cartridge requires less moving components than the conventional one, it is less expensive. Therefore, maintenance of the image forming apparatus is easier, and the running cost of the apparatus is low.

DETAILED DESCRIPTION OF THE PREFERRED EMBODIMENTS

Certain preferred embodiments of the invention will now be described, with reference to the accompanying drawings.

Figure 2:
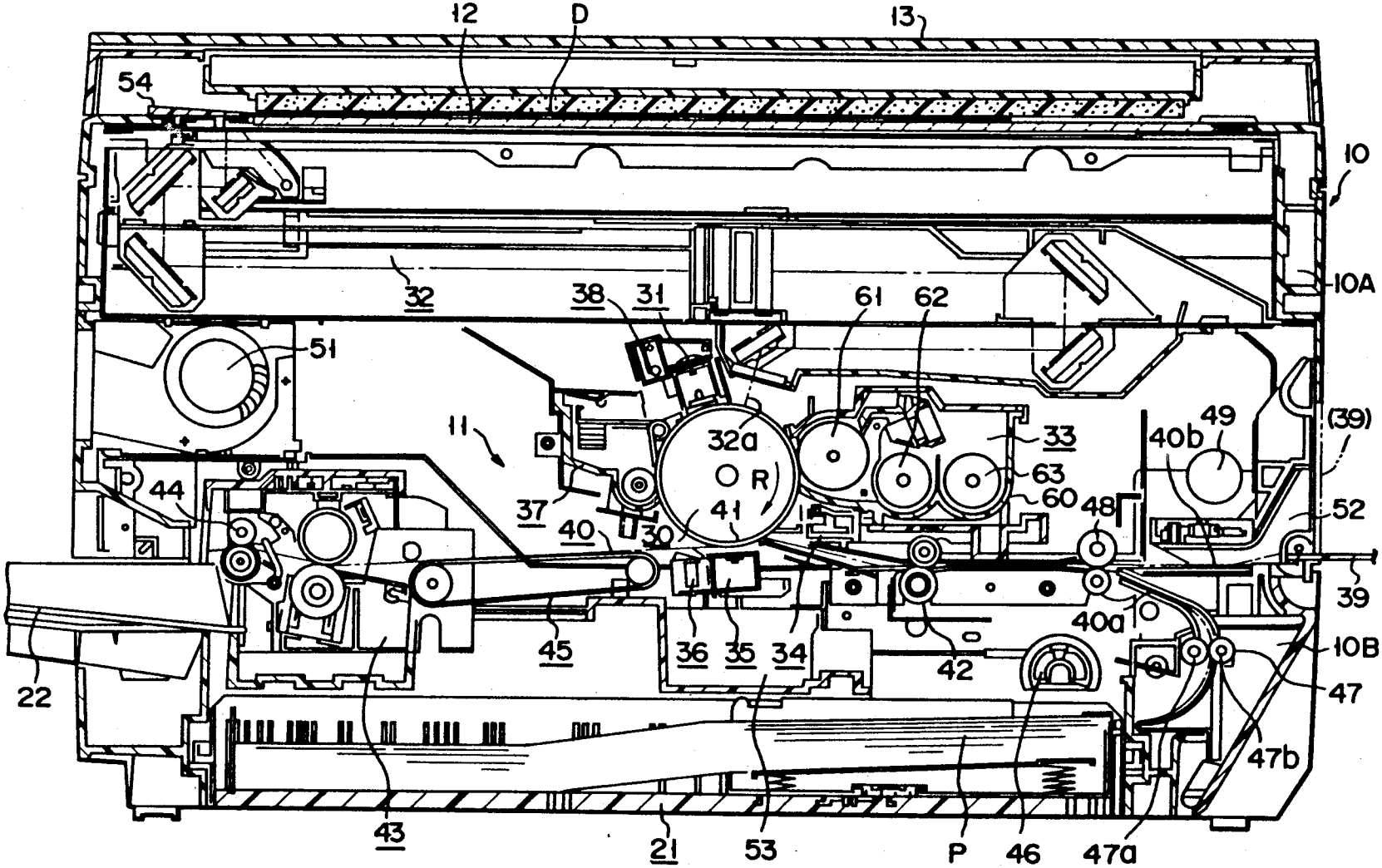
FIG. 2 is a cross-sectional view illustrating the internal structure of the image forming apparatus shown in FIG. 1.

FIG. 2 shows an image forming apparatus according to a first embodiment of the present invention. As is shown in this figure, the apparatus has a housing 10. An image-forming section is incorporated in the housing 10, and a glass plate 12 covers the top of the housing 10, for supporting an original document D.

Figure 1:
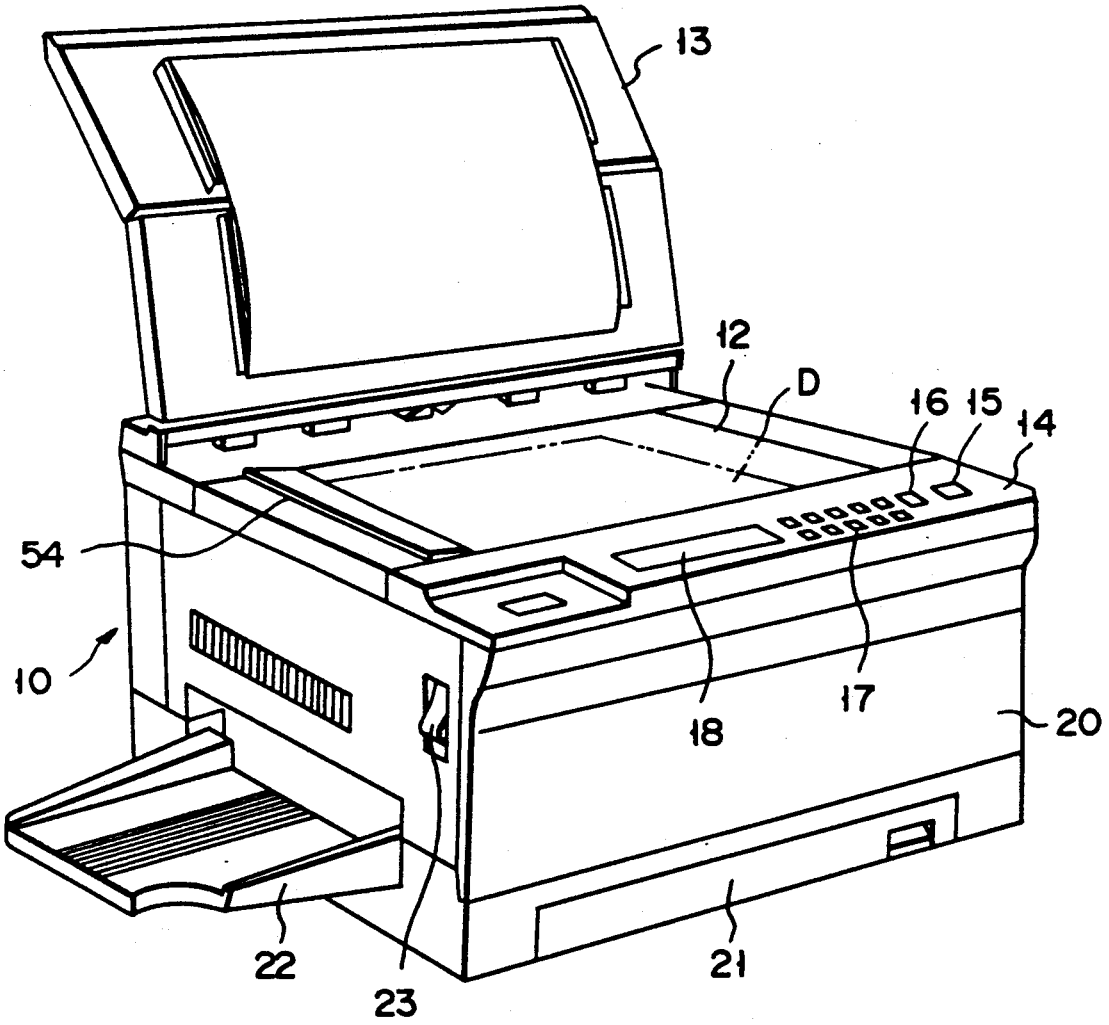
FIG. 1 is a perspective view showing an image forming apparatus according to a first embodiment of the present invention.

As is shown in FIG. 1, a cover 13 is connected to the upper-rear edge of the housing 10, for holding the document D placed on the glass plate 12. A control panel 14 is provided on the top of the housing 10. The panel 14 has a copy key 15, a stop key 16, a numerical key pad 17, and a display 18.

A front cover 20 covers the front of the housing 10 and can be opened. A paper cassette 21 which is inserted in the housing 10 and can be drawn from the front thereof, contains a stack of paper sheets P which are to be supplied to the image-forming section 11. A power switch 23 and a receiving tray 22, for collecting the copied sheets P supplied from the housing 10, are provided on the left side of the housing 10.

As is shown in FIG. 2, the image-forming section 11 comprises a photosensitive drum 30, a charger unit 31, an exposure unit 32, a developer unit 33, a pre-transfer exposure unit 34, a transfer charger unit 35, a separation charger unit 36, a cleaner unit 37, and a discharge unit 38. The drum 30 is located in the center portion of the image-forming section 11. It can rotate in the direction of the arrow R. The units 31 to 38 are arranged sequentially, around the photosensitive drum 30.

A paper transport path 40 is defined within the housing 10. Through this path 40, the paper sheet P is guided to the receiving tray 22, passing by an image transfer position 41 between the drum 30 and the transfer charge unit 35. The sheets P can be supplied to the image-forming section 11, either from the cassette 21 by means of a paper-feeding roller 46 or from a manual-feed table 39 by a pair of paper-feeding rollers 48.

An aligning-roller mechanism 42 is located upstream of the image transfer position 41 with respect to the paper transport path 40. A fixing unit 43 and an exit-roller mechanism 44 are located downstream of the position 41 with respect to the paper transport path 40. A conveyer belt unit 45 extends horizontally between the separation charger unit 36 and the fixing unit 43.

The paper-feeding roller 46 is located near the position where the paper cassette 21 is set. This roller 46 is used to feed the paper sheets P, one by one, from the cassette 21. Each sheet P fed from the cassette 21 is further fed a first branch path **40*a*, which is the upstream part of path 40, by means of paper separating-/feeding mechanism 47, which comprises a paper-feeding roller 47*a* and a paper-separating roller 47*b*. A second branch path 40*b*, for guiding any sheet P placed on the manual-feed table 39, is connected to the first branch path 40*a*. The paper-feeding rollers 48 are located at the junction of the first and second branch paths 40*a* and 40*b***.

Figure 3:
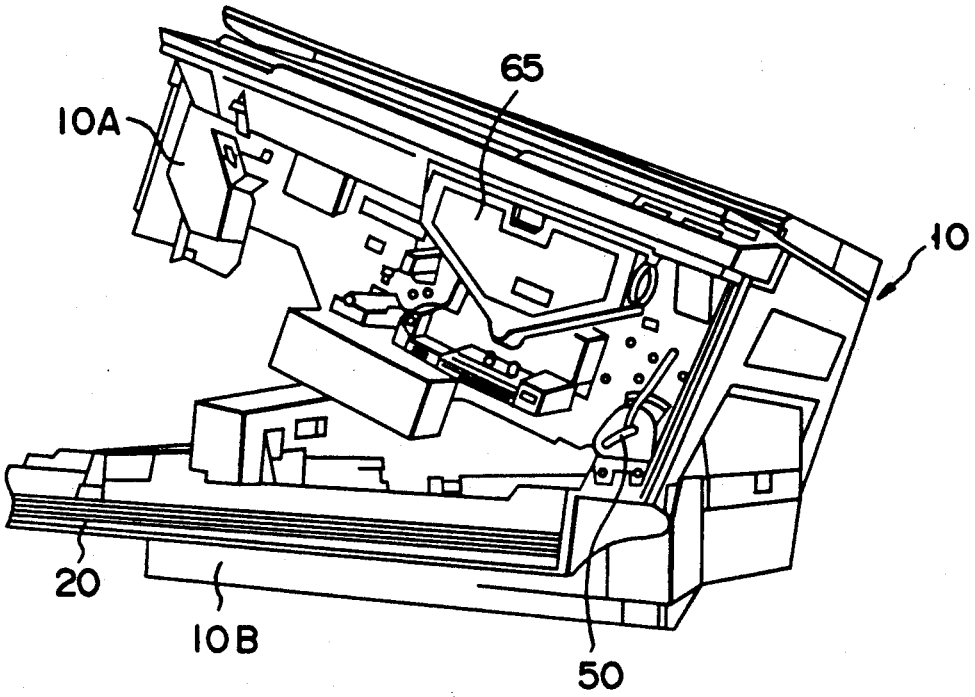
FIG. 3 is a perspective view showing the upper unit of the image forming apparatus in an open state.

The housing 10 comprises two units, i.e., an upper unit 10A located above the paper transport path 40, and a lower unit 10B located below the path 40. As is illustrated in FIG. 3, the upper unit 10A can be swung upward around an axle 49 (FIG. 2) through an angle of about 25 degrees, and the housing can thus be opened. The axle 49 is the middle portion of a torsion bar 50 which urges the upper unit 10A to rotate upward and open.

As is shown in FIG. 2, a cooling fan 51 is located above the fixing unit 43. A manual-feed guide 52 is located near the manual-feed table 39, for guiding each paper sheet P fed from the table 39. A high-voltage transformer 53 is provided below the transfer charger unit 35 and the fixing unit 36. Further, a scale 54 is mounted on the glass plate 12, extending along one side thereof. This scale 54 helps the operator to place the original document D in the proper position on the glass plate 12.

Figure 4:
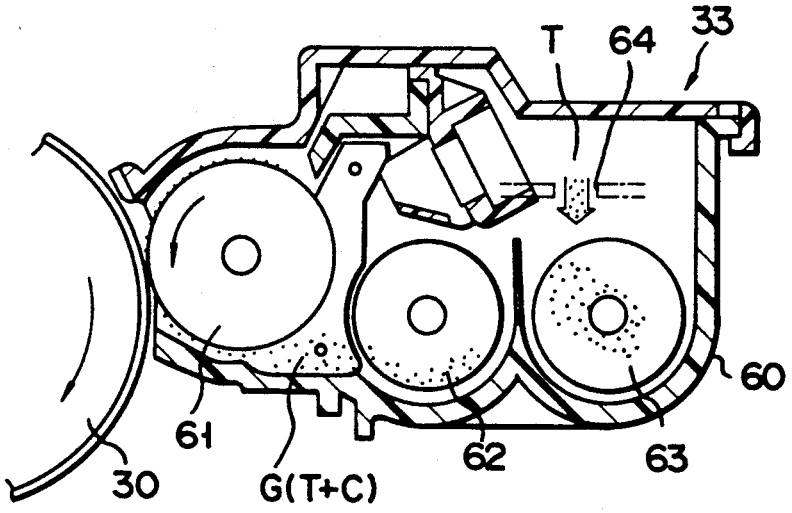
FIG. 4 is a cross-sectional view showing the developing device incorporated in the image forming apparatus.

Referring to FIG. 4, the developer unit 33 has a casing 60. It further comprises a magnet roller 61, a first stirring-auger shaft 62, and a second stirring-auger shaft 63—all arranged within the casing 60. The casing 60 contains two-component developing agent G which consist of toner T and carrier C. The magnet roller 61 can be rotated in the direction of the arrow, such that a thin layer of agent G is formed on its circumferential surface.

Figure 5:
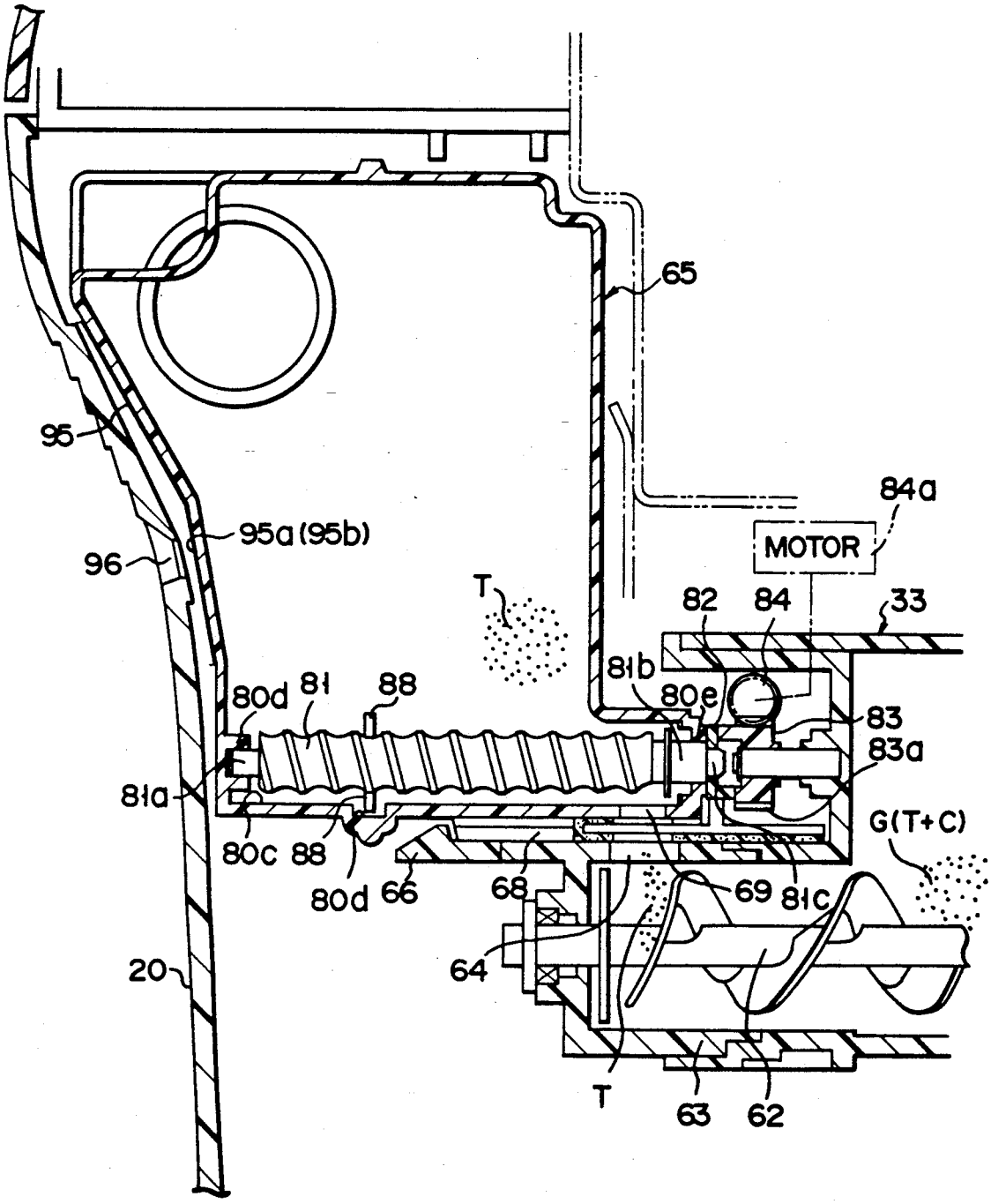
FIG. 5 is a sectional view of the cartridge receptacle of the image forming apparatus.

As is illustrated in FIGS. 4 and 5, the casing 60 has a toner inlet port 64 located right above one end of the second stirring-auger shaft 63, through which the toner T can be supplied into the casing 60 from a toner cartridge 65.

Figure 6:
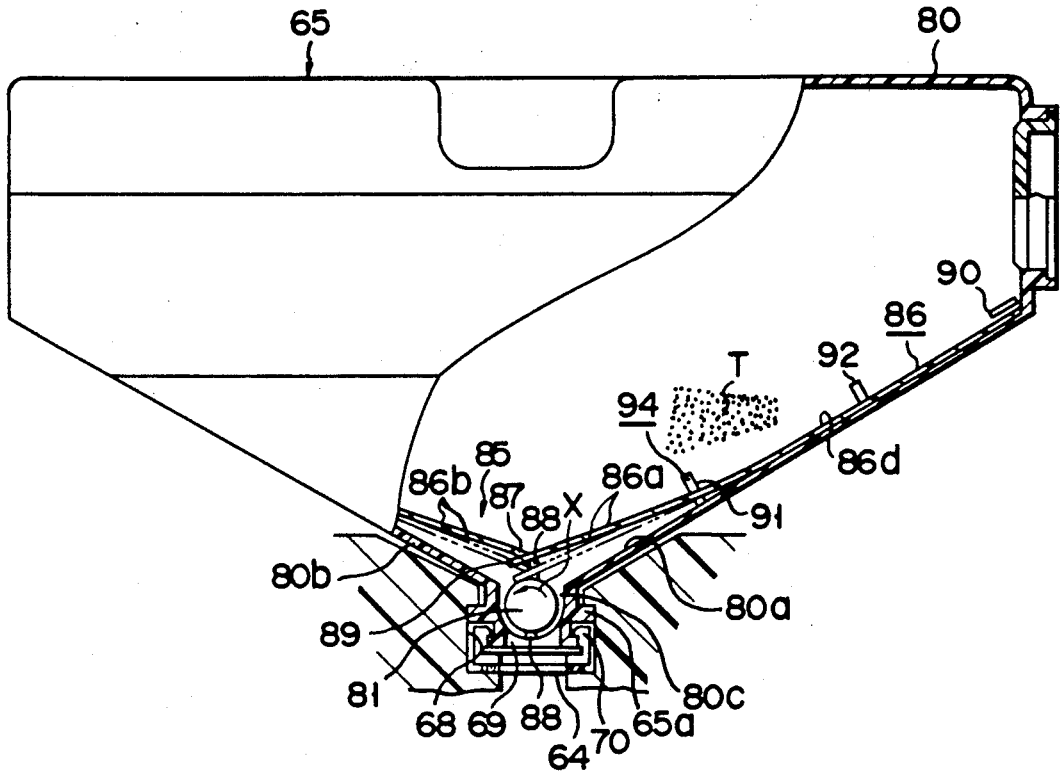
FIG. 6 is a partly sectional, front view of the lower portion of a toner cartridge held within the cartridge receptacle.

The toner cartridge 65 is set within the housing 10, in a position where it opposes the front cover 20. Hence, the toner cartridge 65 is exposed when the front cover 20 is opened as is shown in FIG. 3. The cartridge 65 has a hollow cylindrical lower end portion, as is illustrated in FIG. 6. A flange **65*a* is mounted on this end portion. The flange 65A is fitted in an annular groove 68 cut in the lower-end portion of the developer unit 33. Thus, the toner cartridge 65 is connected to the developer unit 33. Further, the cartridge 65 is held in place by a hook 66 which is formed integral with the developer unit 33. The cartridge 65 can be detached from the unit 33 when pulled forward while the distal end of the hook 66** is elastically bent downward.

Once the toner cartridge 65 has been attached to developer unit 33, a shutter 70 (FIG. 6) slides and opens. As a result, the toner outlet port 69 of the toner cartridge 65 opposes the toner inlet port 64 of the developer unit 33.

Figure 7:
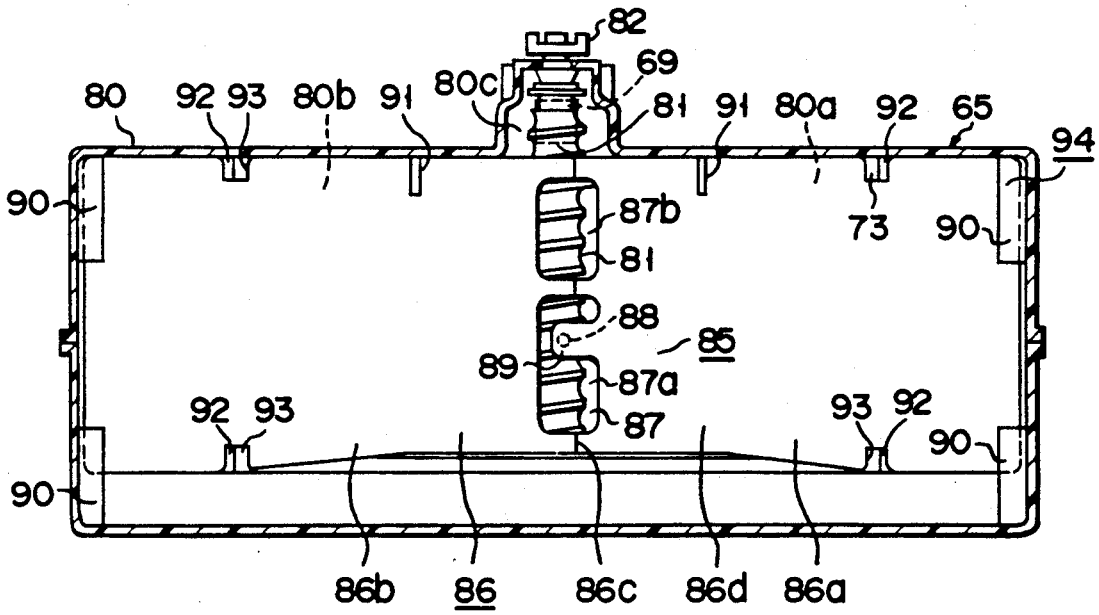
FIG. 7 is a sectional view of the toner cartridge.

As is illustrated in FIGS. 5, 6, and 7, the toner cartridge 65 has a hopper 80 made of synthetic resin. As is shown in FIG. 6, the hopper 80 has a first lower surface 80*a* inclining downward, a second lower surface 80*b* inclining downward toward the lower end of the first lower surface 80*a*, and a horizontal trough 80*c* connected to the lower ends of the lower surfaces 80*a* and 80*b*. The hopper 80 contains a predetermined amount of toner T. The toner T can be supplied from the hopper 80 into the developer unit 33 through the toner outlet port 69 of the hopper 80 and the toner inlet port 64 of the developer unit 33.

A toner-supplying auger 81 made of synthetic resin is rotatably located within the horizontal trough 80*c* of the hopper 80. The auger 81 is supported at one end 81*a* by a first bearing 80*d* formed in one end of trough 80*c*, and at the other end 81*b* by a second bearing 80*e* formed in the other end of trough 80*c*.

As is shown in FIGS. 5 and 7, a projection 81*c* extends from the end 81*b* of the toner-supplying auger 81. A first coupling 82 is fastened to the projection 81*c*. As is illustrated in FIG. 5, the first coupling 82 is connected to a second coupling 83 fastened to the developer unit 33. The second coupling 83 has gear teeth 83*a* on its circumferential surface. A worm gear 84 is in mesh with these teeth 83*a*. The worm gear 84 is coupled to an electric motor 84*a* and can be rotated thereby.

When the motor 84*a* is driven in accordance with a toner supply signal, the worm gear 84 is rotated, thus rotating the second coupling 83 and hence the first coupling 82. As a result, the toner-supplying auger 81, which is connected to the first coupling 82, is rotated in the direction of an arrow X (FIG. 6), supplying the toner T from the trough 80*c* of the hopper 80 into the developer unit 33 through the toner outlet port 69 and the toner inlet port 64. Toner-agitating means 85, which is provided within the hopper 80 of the toner cartridge 65, is designed to agitate the toner T contained in the hopper 80, thereby preventing the toner T from cohering into solid masses or from sticking to the inner surface of the hopper 80.

As is illustrated in FIGS. 6 to 9, the toner-agitating means 85 comprises a toner-receiving plate 86 loosely mounted on and overlapping the lower surfaces 80*a* and 80*b* of the hopper 80, and two pins 88 protruding from the periphery of the auger 81 and spaced 180 degrees apart from each other along the circumference of the auger 81. As can be evident from FIG. 8, the toner-receiving plate 86 is made of a single, elastic sheet 86*d* made of polyethylene. As is evident from FIGS. 6 and 7, the plate 86 is constructed of two portions 86*a* and 86*b* which are connected at base 86*c* in a V-shape and laid on the lower surfaces 80*a* and 80*b* of the hopper 80. Two openings 87*a* and 87*b* are cut in the bases 86*c* of the portions 86*a* and 86*b*. These openings 87*a* and 87*b* form a toner outlet port 87, through which the toner T falls into the trough 80*c*.

Figure 9:
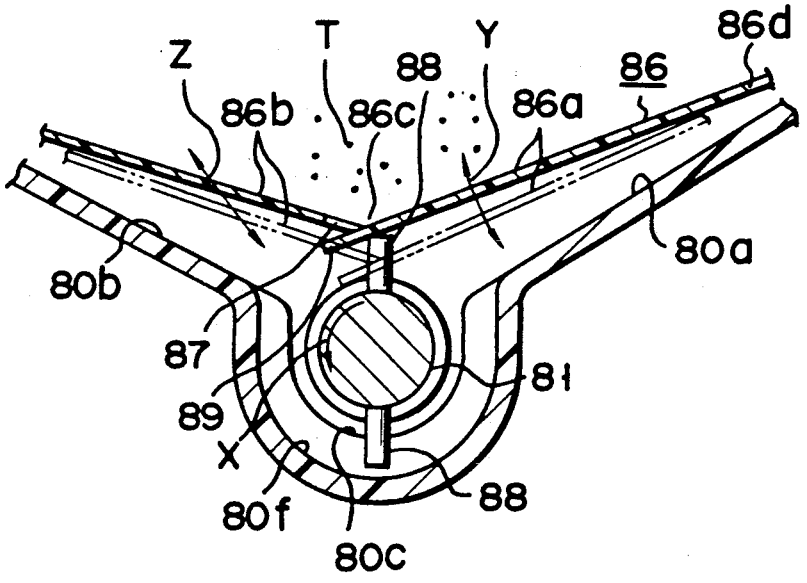
FIG. 9 is a sectional view showing the lower part of the toner cartridge.

A projection 89 extends slantwise from the base 86*c* of the first portion 86*a* of the plate 86, such that its lower surface contacts the periphery of the auger 81. Hence, as the auger 81 rotates, the pins 88 protruding from the periphery of the auger 81 repeatedly strike this projection 89, causing it to jump. As a result, the toner-receiving plate 86 is vibrated. As is illustrated in FIGS. 5 and 9, a groove 80*f* is cut in the inner periphery of the trough 80*c*. The pins 88 pass through this groove 80*f* as the auger 81 rotates.

As can be understood from FIGS. 6 and 7, the toner-receiving plate 86 is held by holding means 94 comprised of ribs 90, 91, 92. The first four ribs 90 are located at the corners of the hopper 80 and fastened to the side walls of the hopper 80. Each of these ribs 90 is spaced apart from the lower surfaces 80*a* and 80*b* for a distance greater than the thickness of the plate 86. The second two ribs 91 hold one lateral edge of the plate 86, more precisely those portions of the lateral edge which are closer to bases 86*c* of the first and second portions 86*a* and 86*b* than to the upper ends thereof. The remaining four ribs 92 are located closer to the upper ends of the first and second portions 86*a* and 86*b* than to the bases 86*c*. The ribs 92 protrude from the bottoms 80*a* and 80*b*, passing through the notches 93 cut in the lateral edges of the plate 86. Hence, the ribs 92 prevent the portions 86*a* and 86*b* from slipping downward. The width of the notches 93 is larger than the thickness of the ribs 92, whereby the toner-receiving plate 86 can be easily assembled and vibrated.

When either pin 88 strikes the projection 89 of the plate 86, and the projection 89 jumps, the first portion 86*a*, which has this projection 89, is vibrated in the direction of the arrow Y (FIG. 9). The second portion 86*b*, which is integral with the first portion 86*a*, is vibrated in the direction of the arrow Z (FIG. 9). As the portions 87*a* and 86*b* of the plate 86 are vibrated in the directions of the arrows Y and Z, the toner T is stirred, and does not cohere into solid masses or stick to the inner surfaces of the hopper 80. Hence, the toner T can fall onto the toner-supplying auger 81 through the openings 87*a* and 87*b* of the plate 86.

As has been described, the toner T in the hopper 80 is prevented from cohering into solid masses, merely by striking the toner-receiving plate 86 by means of the pins 88 protruding from the toner-supplying auger 81. Obviously, the toner-agitating means 85 is more simple and less expensive than the toner-stirring means used in the conventional toner cartridge, which has a plurality of gears. Since all of toner T contained in the hopper 80 is reliably vibrated as the toner-receiving plate 86 vibrates, the toner T can be prevented from cohering into solid masses even if the lower surfaces 80*a* and 80*b* are broader than the bottom of the conventional toner cartridge. Therefore, the toner cartridge can contain more toner T and can last longer than the conventional toner cartridge. Hence, the toner cartridge according to the invention is more economical and easier to maintain.

Figure 10:
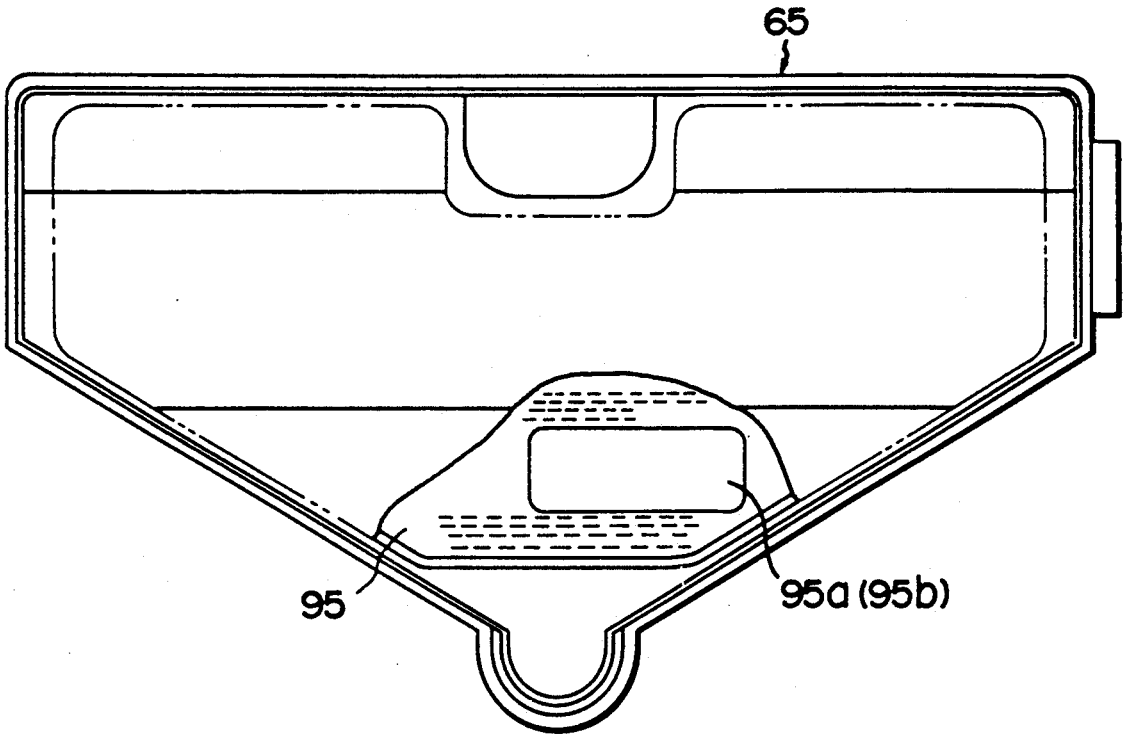
FIG. 10 is a partly sectional side view of the toner catridge, illustrating a label attached thereto.
Figure 11:
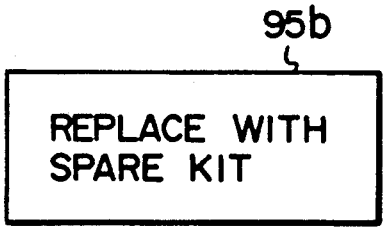
FIG. 11 is a view showing the label, with a message printed thereon.
Figure 12:
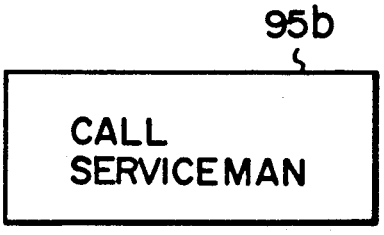
FIG. 12 is a view showing another label with a message printed thereon.

As can be understood from FIGS. 5 and 10, a label 95 is glued to one side of the toner cartridge 65. A mark 95*a* is printed on this label 95, in either black or red, i.e., the color of the toner T contained in the cartridge 65. Two or more toner cartridges 95 can be provided for the image forming apparatus (FIG. 1). In this case, a message 95*b*, such as "REPLACE WITH SPARE KIT," or "CALL SERVICEMAN," as well as a toner-color mark 95*b*, is printed on the label 95 glued to the last cartridge 65 to be used.

As is illustrated in FIG. 5, a window 96 is made in the front cover 20, at such a position that an operator can see, through this window 96, both the mark 95*a* and the message 95*b* on the cartridge 65. Hence, the operator can know whether or not the cartridge 65 set in the image forming apparatus is the last one, or whether or not he or she needs to order new toner cartridges 65.

The present invention is not limited to the embodiment described above. Various changes and modifications can be made. For example, the toner-receiving plate 86 can be made of any material which has the proper elasticity. It is preferable that the plate 86 be made of elastic material which is electrostatic enough to promote the electrical charging of the toner T contained in the cartridge 65.

Figure 8:
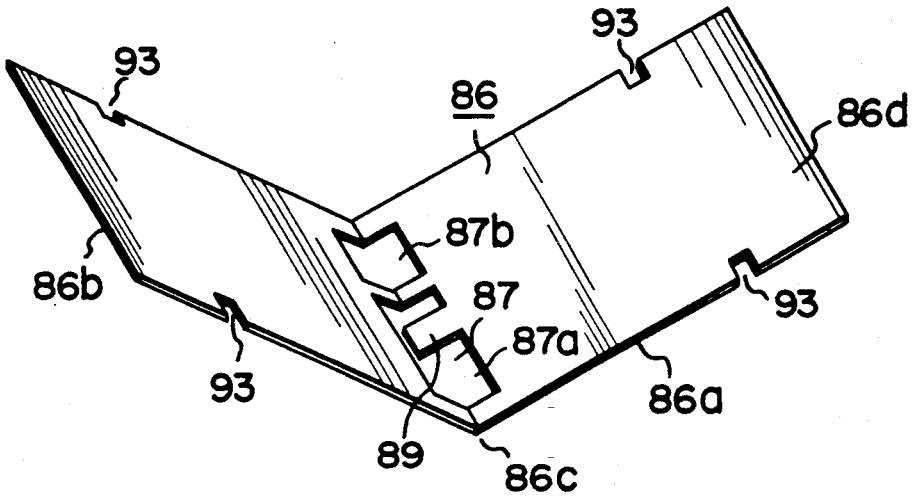
FIG. 8 is a perspective view, illustrating the inclined bottom plates of the toner cartridge.

Further, the toner-receiving plate 86 can be formed of two elastic sheets equivalent to the portions 86*a* and 86*b*, instead of a single elastic sheet (FIG. 8). If this is the case, the two sheets must be bonded to each other at their bases 86*c*.

Figure 13:
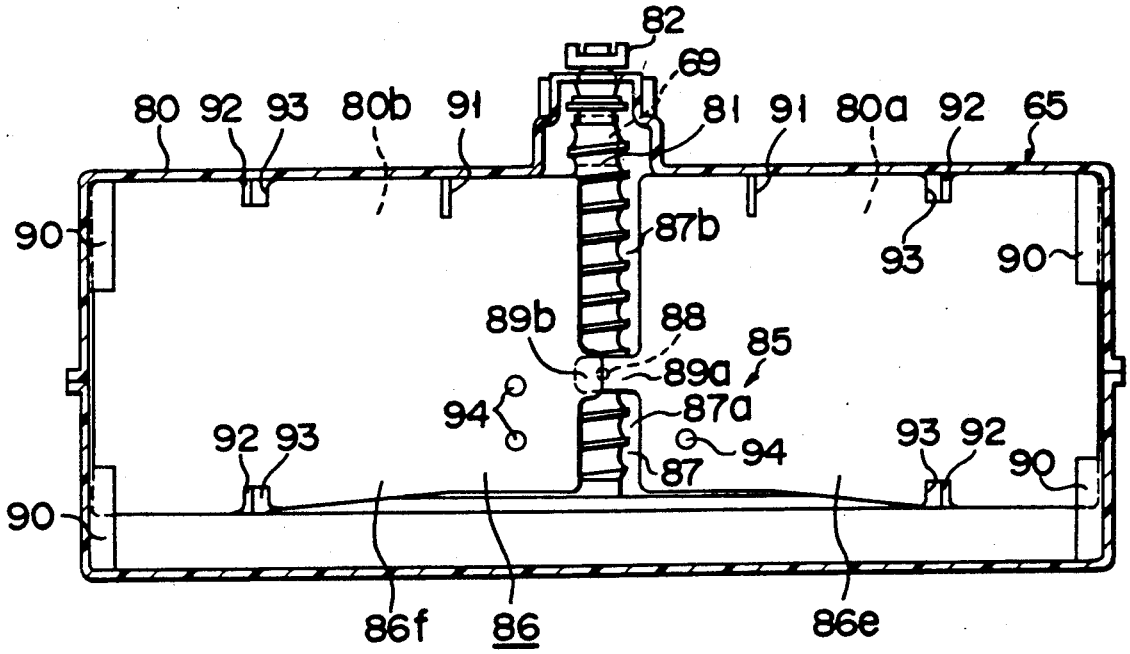
FIG. 13 is a sectional view of another toner cartridge according to the present invention.

FIG. 13 shows a toner-receiving plate 86 which comprises two elastic sheets 86*e* and 86*f* which are each placed on the first and second bottoms 80*a* and 80*b* of the hopper 80. A projection 89*a* protrudes from the lower end of the first sheet 86*e*. Similarly, a projection 89*b* protrudes from the lower end of the second sheet 86*f*. The free-end portion of the projection 89*a* contacts the periphery of the toner-supplying auger 81, whereas the free-end portion of the projection 89*b* is mounted on the projection 89*a* of the first sheet 86*e*. When the auger 81 is rotated, the pins 88 protruding from the periphery of the auger 81 strike the projection 89*a*, causing this projection to jump, and the projection 89*b* also jumps. As a result, both the elastic sheets 86*e* and 86*f* are vibrated. To distinguish the first elastic sheets 86*e* and 86*f* from each other, thereby to facilitate the assembling of the toner-receiving plate 86, one hole 94 can be cut in the sheet 86*e*, and two holes 94 can be made in the second elastic sheet 86*f*.

Furthermore, the number of the pins the auger 81 is not limited to two. The auger 81 can have one pin, or three or more pins.

What is claimed is:

1. A toner cartridge for supplying toner to a developing device having a toner-inlet port, said toner cartridge comprising:

means for storing toner having at least one lower surface inclined downwardly, and a toner outlet port through which toner is supplied to the toner-inlet port of the developing device;

toner transport means located in the toner storage means, for supplying toner to the toner outlet port;

toner guiding means for guiding toner from the toner storage means to the toner transport means, said toner guiding means having an inclined plate or plates substantially superposing each lower surface of the toner storage means, and an opening formed in the lower end or ends of the inclined plate or plates, for guiding toner into the toner transport means; and vibration means attached to the toner transport means, for vibrating the inclined plate or plates as the toner transport means operates to supply toner to the outlet port.

2. The toner cartridge according to claim 1, wherein said toner storage means is a synthetic resin body.

3. The toner cartridge according to claim 1, wherein said toner guiding means includes an elastic sheet mounted on on each inclined lower surface of said toner storage means.

4. The toner cartridge according to claim 1, wherein said toner guiding means includes an electrostatic elastic sheet, to promote electrical charging of the toner.

5. The toner cartridge according to claim 1, wherein said toner transport means includes an auger rotatably contained in the toner storage means.

6. The toner cartridge according to claim 1, wherein said vibration means has at least one pin protruding from the surface of said toner transport means.

7. The toner cartridge according to claim 6, wherein said vibration means has two pins protruding from the surface of said circular toner transport means, said pins being spaced 180 degrees from each other along the circumference of said toner transport means.

8. An image forming apparatus which comprises:

image-forming means for forming an image on an image carrier;

developing means for developing an image formed on the image carrier by the image-forming means; and a toner cartridge comprising: toner storage means having a first lower surface inclined downwardly, a second lower surface inclined downwardly toward the lower end of the first lower surface, and a toner outlet port through which toner is supplied to the toner inlet port of the developing device; toner transport means located near the toner-outlet port of the toner storage means, for supplying toner to the toner outlet port; toner-guiding means for guiding toner from the toner storage means to the toner transport means, said toner guiding means having a first inclined plate substantially superposing the first lower surface of the toner storage means, a second inclined plate substantially superposing the second lower surface of the toner storage means, and an opening formed in the lower ends of the inclined plates, for guiding toner to the toner transport means; and vibration means attached to the toner transport means, for vibrating the first and second inclined plates as the toner transport means operates to supply toner outlet port.

9. The image forming apparatus according to claim 8, wherein said toner storage means is a synthetic resin body.

10. The image forming apparatus according to claim 8, further comprising a plurality of ribs mounted on, and located in the vicinity of, the first and second inclined lower surfaces of said toner storage means, these ribs supporting said first and second inclined plates such that said inclined plates can vibrate.

11. The image forming apparatus according to claim 8, wherein said toner guiding means includes a single elastic sheet bent in the middle, including a first inclined portion and a second inclined portion.

12. The image forming apparatus according to claim 8, wherein said toner guiding means includes a first elastic sheet and a second elastic sheet which are mounted on the first and second inclined lower surfaces of said toner-storage means, respectively.

13. The image forming apparatus according to claim 8, wherein said toner guiding means includes an electrostatic elastic sheet to promote electrical charging of the toner.

14. The image forming apparatus according to claim 8, wherein said toner transport means has an auger rotatably located in the toner storage means.

15. The image forming apparatus according to claim 8, wherein said vibration means has at least one pin protruding from the surface of said toner transport means.

16. The image forming apparatus according to claim 15, wherein said vibration means has two pins protruding from the surface of said toner transport means, the pins being spaced 180 degrees from each other along the circumference of said toner transport means.

17. A toner cartridge for supplying toner to a developing device having a toner inlet port, said toner cartridge comprising:

means for storing the toner to be supplied, said storing means having a toner outlet port for supplying toner to said toner inlet port;

means for supplying toner to said toner outlet port;

means for guiding toner from said storing means to said supplying means, said guiding means having first and second inclined portions provided in said storing means and substantially superposing the lower surface of the cartridge, and an opening provided in the lower ends of said first and second inclined portions; and means for vibrating said first and second inclined portions as said supplying means operates, wherein toner may be supplied to said toner outlet port through said first and second inclined portions and said opening of said guiding means.

18. The toner cartridge according to claim 17, wherein said transporting means has a roller for transporting toner.

19. An image forming apparatus comprising:

means for forming am image on an image carrier;

means for developing the image formed on the image carrier by said forming means, said developing means having toner inlet port; and cartridge means for supplying toner to said developing means, said supplying means including:

(a) means for storing toner to be supplied, said storing means having a toner outlet port for supplying toner to said toner inlet port;

(b) means for transporting toner to said toner outlet port;

(c) means for guiding toner from said storing means to said transporting means, said guiding means having first and second inclined portions provided in said storing means, and substantially superposing the lower portions of said cartridge, and an opening provided on the lower ends of said first and second inclined portions; and (d) means for vibrating said first and second inclined portions as said supplying means operates, wherein toner may be supplied to said toner outlet port through said first and second inclined plates and said opening of said guiding means.

20. The image forming apparatus according to claim 19, wherein said supplying means includes a roller for transporting toner.

21. A toner cartridge for supplying toner to a developing device having a toner-inlet port, said toner cartridge comprising:

means for storing toner having a first lower surface inclined downwardly, a second lower surface inclined downwardly toward the lower end of the first lower surface, and a toner outlet port through which toner is supplied to the toner-inlet port of the developing device;

toner transport means located in the toner storage means, for supplying toner to the toner outlet port;

toner guiding means for guiding toner from the toner storage means to the toner transport means, said toner guiding means having a first inclined plate substantially superposing the first lower surface of the toner storage means, a second inclined plate substantially superposing the second lower surface of the toner storage means, and an opening formed in the lower ends of the inclined plates, for guiding toner into the toner transport means;

vibration means attached to the toner transport means, for vibrating the first and second inclined plates as the toner transport means operates to supply toner to the outlet port; and, a plurality of ribs mounted on, and located in the vicinity of, the first and second inclined bottoms of said toner storage means, these ribs supporting said first and second inclined plates such that said inclined plates can vibrate.

22. A toner cartridge for supplying toner to a developing device having a toner-inlet port, said toner cartridge comprising:

means for storing toner having a first lower surface inclined downwardly, a second lower surface inclined downwardly toward the lower end of the first lower surface, and a toner outlet port through which toner is supplied to the toner-inlet port of the developing device;

toner transport means located in the toner storage means, for supplying toner to the toner outlet port;

toner guiding means for guiding toner from the toner storage means to the toner transport means, said toner guiding means having a first inclined plate substantially superposing the first lower surface of the toner storage means, a second inclined plate substantially superposing the second lower surface of the toner storage means, and an opening formed in the lower ends of the inclined plates, for guiding toner into the toner transport means, the toner guiding means including a single elastic sheet bent in the middle; including a first inclined portion and a second inclined portion; and vibration means attached to the toner transport means, for vibrating the first and second inclined plates as the toner transport means operates to supply toner to the outlet port.

23. A toner cartridge for supplying toner to a developing device having a toner inlet port, said toner cartridge comprising:

means for storing toner having at least one lower surface inclined downwardly to the lower end of the cartridge, and a toner outlet port through which the toner is supplied to the toner inlet port of the developing device;

toner transport means located in the toner storage means, for supplying toner to the toner outlet port;

toner guiding means for guiding toner from the toner storage means to the toner transport means, said toner guiding means having at least one inclined plate substantially superimposing at least one lower surface of the toner storage means, and an opening formed in the lower end of the said one inclined plate for guiding toner into the toner transport means; and vibrating means attached to the toner transport means, for vibrating the at least one inclined plate as the toner transport means operates the supply toner to the outlet port.

* * * * *